United States Patent [19]

Grimes et al.

[11] Patent Number: 4,705,611

[45] Date of Patent: Nov. 10, 1987

[54] METHOD FOR INTERNALLY ELECTROPOLISHING TUBES

[75] Inventors: Thomas L. Grimes; Robert Roeland, both of Kalamazoo; Frederic H. Schadewald, Richland, all of Mich.

[73] Assignee: The Upjohn Company, Kalamazoo, Mich.

[21] Appl. No.: 848,885

[22] Filed: Apr. 7, 1986

Related U.S. Application Data

[62] Division of Ser. No. 636,198, Jul. 31, 1984, Pat. No. 4,601,802.

[51] Int. Cl.[4] ..... C25F 3/24

[52] U.S. Cl. ..... 204/129.1; 204/237; 204/212; 204/272; 204/275; 204/269

[58] Field of Search ..... 204/129.1, 212, 272, 204/141.5, 269, 237, 224 R, 225, 275

[56] References Cited

U.S. PATENT DOCUMENTS

| | | | |
|---|---|---|---|
| 1,215,856 | 2/1917 | Raymond | 204/212 |
| 1,927,162 | 9/1933 | Fiedler | 204/212 |
| 2,475,586 | 7/1949 | Bartlett | 204/140 |
| 2,689,215 | 9/1954 | Bart | 204/26 |
| 2,764,540 | 9/1956 | Farin et al. | 204/140.5 |
| 2,970,950 | 1/1959 | Bahmann | 204/26 |
| 3,429,787 | 2/1969 | Weinreich | 204/272 |
| 3,533,926 | 10/1970 | Zubak et al. | 204/129.1 |
| 3,649,477 | 3/1972 | Bart | 204/26 |
| 3,857,772 | 12/1974 | Sasaki | 204/272 |
| 3,919,061 | 11/1975 | Jumer | 204/129.6 |
| 3,939,053 | 2/1976 | Diepers et al. | 204/212 |
| 3,941,677 | 3/1976 | Bourne | 204/272 |
| 4,014,765 | 3/1977 | Roth et al. | 204/129.43 |
| 4,125,447 | 11/1978 | Bachert | 204/222 |
| 4,156,637 | 5/1979 | Jumer | 204/129.1 |
| 4,441,976 | 4/1984 | Iemmi | 204/272 |

FOREIGN PATENT DOCUMENTS

| | | | |
|---|---|---|---|
| 1209242 | 2/1960 | France . | |
| 200075 | 12/1938 | Switzerland . | |
| 288200 | 8/1971 | U.S.S.R. | 204/212 |

*Primary Examiner*—Donald R. Valentine

*Attorney, Agent, or Firm*—Flynn, Thiel, Boutell & Tanis

[57] ABSTRACT

An apparatus for internally electropolishing tubes in which a plurality of elongate tubes are horizontally supported and rotatably driven about their length axes. An outlet fitting including an end dam permits rotation of the tube outlet end therein, allows escape of gases from the upper portion of the tube, and permits overflow of electrolyte liquid thereover and fixedly supports the end of a cathode rod. The cathode rod is formed as two aligned, axially adjacent partial length sections. The positive terminal of an electric current supply connects at a plurality of points to the tube along its length and connects at its negative terminal individually to the outer ends of the two cathode sections.

10 Claims, 11 Drawing Figures

METHOD FOR INTERNALLY ELECTROPOLISHING TUBES

This is a division of application Ser. No. 636,198 filed July 31, 1984 now U.S. Pat. No. 4,601,802.

FIELD OF THE INVENTION

This invention relates to an apparatus for electropolishing the interiors of tubes, namely of hollow elongate members of various types, including pipes, lengths of tubing and the like, and more particularly to apparatus for electropolishing the interior of rotatable tubes.

BACKGROUND OF THE INVENTION

The invention was developed in connection with the electropolishing of metal tubes, including tubes of stainless steel, for use in manufacture of pharmaceuticals, in which smooth, contaminant-free surfaces are desired.

However, it will be understood that the apparatus of the present invention is to be used to electropolish the interiors of tubes for a variety of purposes and uses outside of pharmaceutical processes.

In general, electropolishing is a process in which metal surface irregularities are removed by anodic dissolution in a suitable electrolyte. An electrolyte is an ionic conductor, i.e., a non-metallic electrical conductor in which current is carried by the movement of ions. With proper selection of agitation, current density, exposure times, specific gravity of the solution, temperature of the solution, and other conditions, the metal surface is smoothed and brightened while metal is removed.

During the electropolishing process, higher projections on the metal surface are removed faster than the lower projections, creating a leveling action. The removal of higher projections is called macropolishing, while the removal of the lower projections is called micropolishing. In electropolishing, both micro- and macro- asperities are preferentially removed. The removal or reduction of the surface micro-asperities increases the surface brightness and reflectivity and reduces surface friction, while the metal smoothness is determined by macropolishing.

In the past, electropolishing has been carried out by immersing the metal object to be electropolished in a tank of electrolyte and applying electropolishing current thereto. However, this has been found cumbersome or otherwise unsatisfactory when it is only the interior of a hollow metal object which requires electropolishing and when the object is more than a few feet long, in which case the required size of tank is excessive.

Bachert U.S. Pat. No. 4,025,447, Bartlett U.S. Pat. No. 2,475,586 and Farren U.S. Pat. No. 2,764,540 each disclose an apparatus for electropolishing a generally cylindrical surface of an object, in which the apparatus includes an electrode disposed approximately concentrically within the object, means for causing a continuous flow of electrolyte between the electrode and the surface to be polished, and an arrangement for applying an electric potential between the electrode and the object. The Bachert patent also discloses in FIG. 2 the provision of radially extending, insulated bristles 11 which help to maintain the concentricity of the electrode within the object. No provision is made for rotating the object.

Farren U.S. Pat. No. 2,764,540 and Zubak U.S. Pat. No. 3,533,926 each disclose a flow-through support for locating the center electrode rod radially in a cylinder, although not for relative rotation.

Roth U.S. Pat. No. 4,014,765 supports for rotation a hollow body to be electropolished, but the entire hollow body to be electropolished is immersed in a tank of electrolyte.

However, the prior devices have not been found entirely satisfactory for electropolishing of elongate metal tubes.

Accordingly, the objects and purposes of the present invention include provision of:

(1) Apparatus for electropolishing elongate metal tubes, including stainless steel tubes, and including commercially available tubes of high length to diameter ratio, for example tubes of up to 20 feet long and longer and having a diameter in a wide range of diameters.

(2) Apparatus as aforesaid capable of simultaneously and continually applying rotation, electric current and flowing electrolyte liquid to the tube to be electropolished while simultaneously and continuously removing therefrom gases produced in the electropolishing operation, for enhanced uniformity and reliability of electropolishing.

(3) Apparatus as aforesaid capable of simultaneously obtaining a similar electropolishing effect on more than one workpiece tube.

(4) Apparatus as aforesaid having a tube support of adequate length for handling elongate tubes but wherein the apparatus can be readily partially disassembled into and reassembled from shorter segments for storage during periods of non-use or movement from location to location.

(5) Apparatus as aforesaid which can be constructed using only relatively simple materials and tools.

Other objects and purposes of this invention will become apparent to persons acquainted with apparatus of this general type upon reading the following specification and inspecting the accompanying drawings.

The objects and purposes of this invention are met by providing an apparatus to internally electropolish tubes. Means horizontally support and rotatably drive at least one elongate tube for rotation about its length axis. Means at opposite ends of the tube respectively supply and allow outflow of electrolyte liquid. Means support an elongate cathode rod within the tube, the cathode rod being fixed and the tube rotating about it. An electric current supply has positive and negative connections to the tube and cathode rod which, in cooperation with the rotation of the tube and flow of electrolyte liquid therethrough, provide for electropolishing of the tube interior.

BRIEF DESCRIPTION OF THE DRAWINGS

FIG. 2, which for convenience in drawing is divided into separate

DETAILED DESCRIPTION

Figure 1:
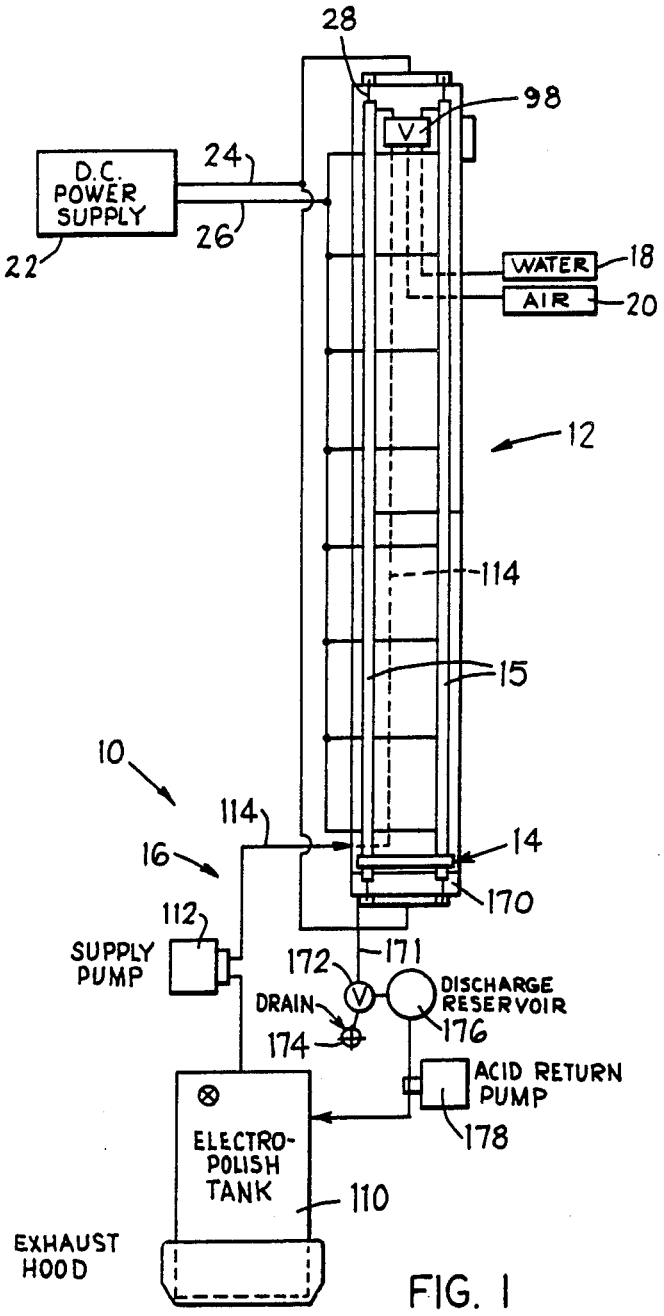
FIG. 1 is a schematic plan view of electropolishing apparatus embodying the invention.

FIG. 1 discloses an apparatus 10 for electropolishing the interior of a pair of elongate tubes 15. In general, the apparatus 10 includes a table 12 for rotatably supporting the tubes 15, a rotation drive 14 for rotatably driving the tubes, an electrolyte supply system 16 for circulating electrolyte through the pipes during electropolishing, de-ionized water and compressed air supplies 18 and 20 for rinsing and drying the tubes after electropolishing and a DC electrical power supply 22 for supplying electric current through conductor paths 24 and 26 to cathode rods disposed within the tubes and to the tubes 15 (which act electrically as anodes).

Figure 2A:
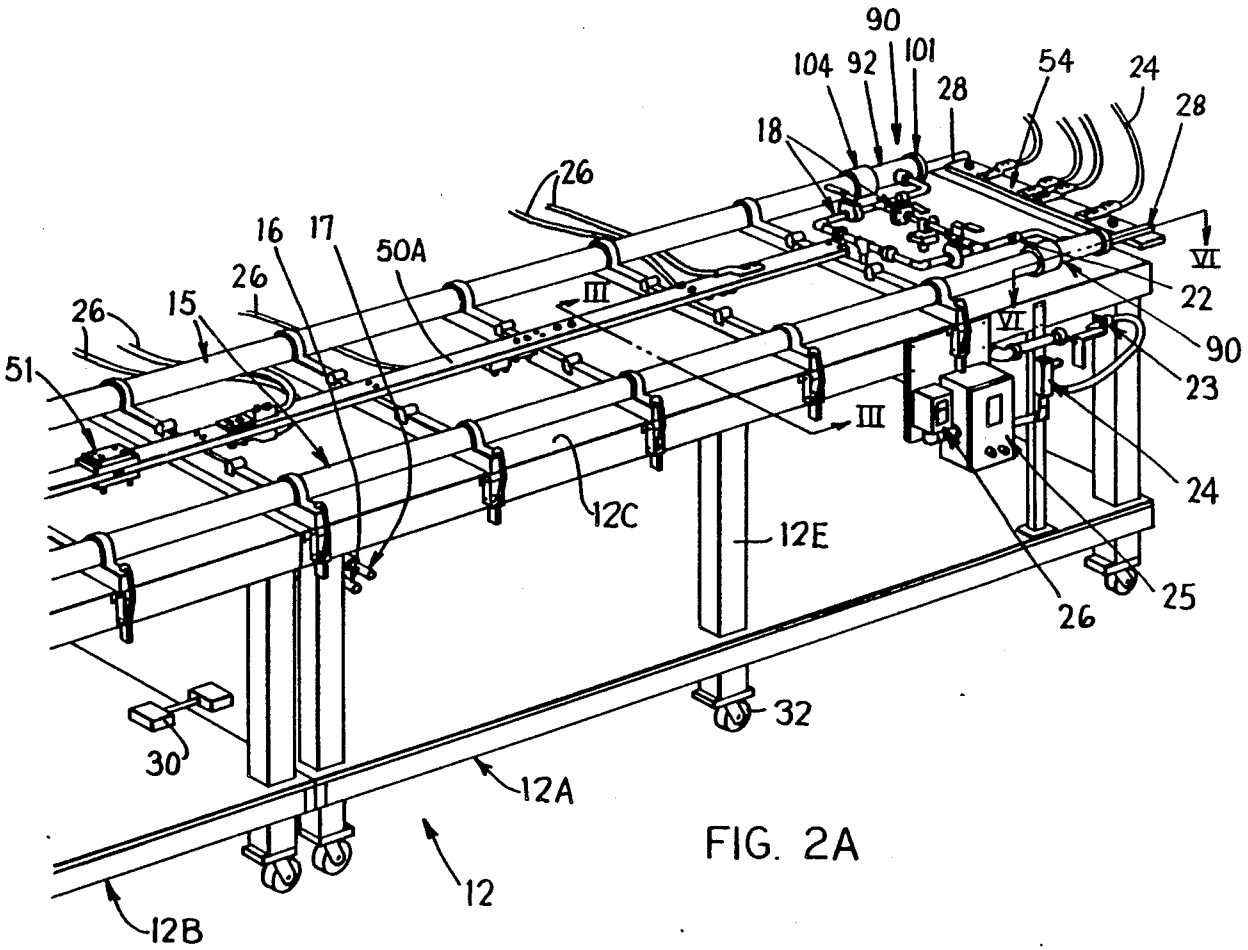
FIGS. 2A and 2B, is an enlarged pictorial view of the table and other portions of the apparatus carried thereon.
Figure 2B:
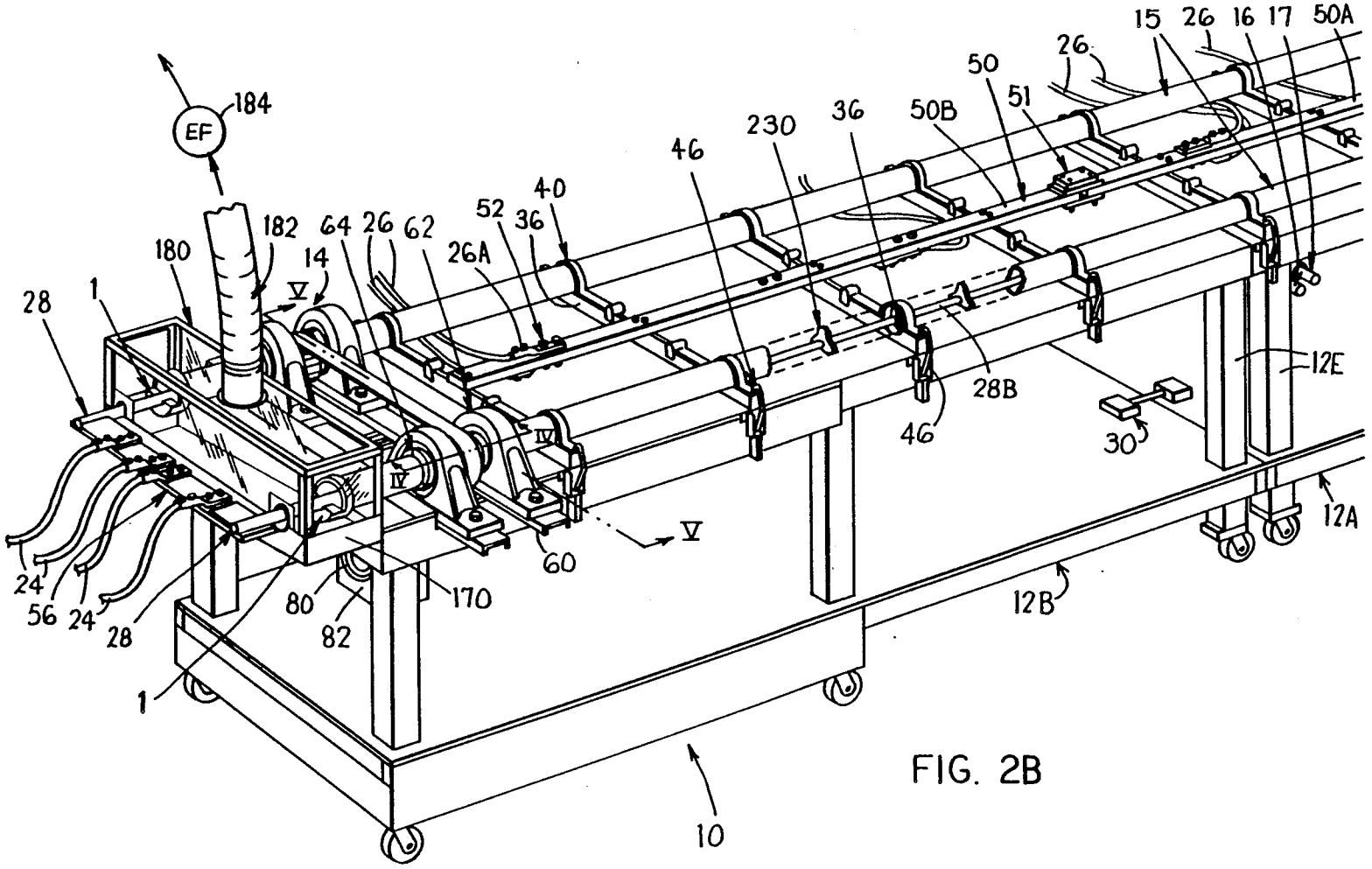

The apparatus 10 here shown is constructed to handle elongate (e.g., 20-foot length) tubes. For convenient storage when not in use, the table 12 is constructed in two half-length sections releasably but rigidly connectable by suitable conventional latching means schematically indicated at 30 (FIG. 2). In the embodiment shown, the table 12 is 36 inches wide, 21 feet long and has a top surface 12C at a comfortable working height. The table is preferably built of a durable wood coated with a protective coating (for example an epoxy paint such as Epi/GARD HiBuilt Epoxy Finish manufactured by DeGraco) to help it resist any acid (electrolyte) spills which may accidentally occur. The table 12 is thus not electrically conductive. If space is a problem and the table is built in the two sections 12A and 12B shown, the sections are joined end to end just prior to beginning of the set-up for polishing of tubes.

In the embodiment shown the table has a lower shelf surface 12B and a plurality of upright legs 12E supporting the shelf and top surface at desired heights above the floor. Wheels or casters 32 on the bottom of the table legs 12E enhance the table's maneuverability and ease of storage. Two jacks (not shown) may be attached to the table to act as levelers if needed.

To rotatably support and provide electrical connection to the tubes 15, a plurality of electrically conductive crossbars (preferably copper) 36 (FIGS. 2 and 3) are spaced longitudinally on the top surface 12C of the table 12 and extend transversely substantially the width thereof. In the embodiment shown, the cross-bars 36 are one-half inch thick by two inches wide (the width dimension being vertical) and are of high electrical conductivity, preferably solid copper. A pair of V-notches 38 are provided in the upper edge of each crossbar 36 near the ends thereof for rotatably receiving therein and supporting the corresponding one of the tubes 15 to be electropolished. At least for smaller than maximum diameter tubes 15, the crossbar 36 is fixed upon a desired thickness wooden shim 36B, in turn fixed upon the top 12C of the table, the thickness of the shim 36B maintaining the axis of the tube 15 at the same height above the table as for tubes of other diameter. Preferably the crossbar 36 is releasably secured by screws to an angle bracket 36A, in turn releasably secured by a screw to the shim 36B, which in turn is screwed to the top of the table. For the largest diameter tube, the crossbar 36 may be secured directly to the table top 12C without an intervening shim.

Figure 3:
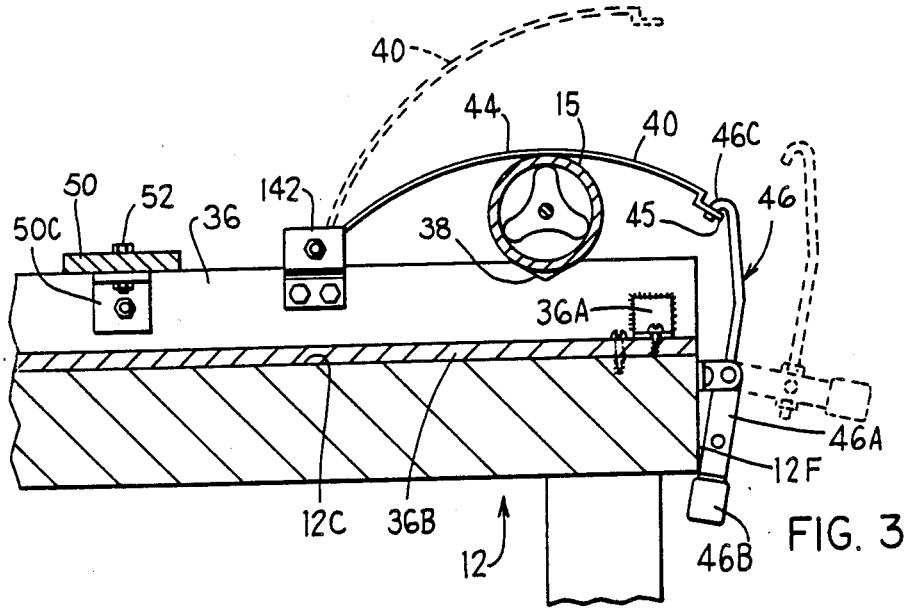
FIG. 3 is an enlarged fragmentary view taken substantially along the line III—III of FIG. 2 and showing one of the electric current clamp connections to the rotating tube.

A high electrical conductivity (preferably copper) saddle clamp strap 40 has its inner end hinged at 42 atop the crossbar 36 near the center of the latter. The mid-portion 44 of the strap 40 is curved to engage the tube 15 to be electropolished over the V-notch 38 in crossbar 36 to secure the tube 15 against rising out of the V-notch 38 with the strap 40 in its downward, closed position shown in solid lines. The outer end 45 of the strap 40 is releasably clamped down against the outer end of the crossbar 36 and to the table 12 by suitable clamp means, here a conventional toggle clamp 46. The clamp 46 here has a bracket 46A fixed to the side 12F of the table top 12C, an activating lever 46B and a hooked strap-engaging rod 46C for engaging a hole in the outer end 45 of the strap 40 as seen in FIG. 3. The lever 46B has an inner end pivoted on bracket 46A. The mid-portion of lever 46B pivotally carries the hooked rod 46C which is axially threadedly adjustable transversely of its pivot on the lever to allow its hooked free upper end to engage and clamp the outer end 45 of the saddle strap despite differences in height of the saddle strap due to differences in the tube diameter and in the height of the crossbar 36 (due to shimming), as required to handle tubes 15 of different diameter. By releasing the lever 46B, the rod 46C can be swung out of clamping engagement with the outer end 45 of the strap 40, thereby permitting the strap 40 to be pivoted inward and upward to its dotted line open position at 40A (FIG. 3), thereby permitting insertion or removal of a tube 15. In its solid line closed position, the surface contact with the tube 15 by the sides of the V-notch 38 in the crossbar 36 and by the strap conducts electric current between the crossbar 36 and tube 15.

The V-notches 38 in the crossbars 36 and the opposed straps 40 preferably are lubricated with a copper particle filled lubricant (sometimes referred to as copper grease), an electrically conductive lubricant which reduces friction while passing electrical current through rotating (and stationary) junctions.

The apparatus 10 shown is adaptable to tubes 15 of a wide range of diameters (for example from three-quarter inch to three inch outside diameter). Such adapting involves substituting different diameter tube engaging parts in the rotational drive 14 and tube 15 connections to the electrolyte supply system 16. Such adapting also involves different thickness shims 36B and threadedly adjusting the rod 46C as to the distance of its hooked end to its pivot on the lever 46B, the same crossbars 36 and saddle straps 40 being retained. This maintains the central axis of tube 15 of different diameter at the same height above the table top 12C, a convenience in connecting the tubes 15 to the rotational drive 14 and the electrolyte inlet and outlet fittings hereafter described.

The top central portions of the crossbars 36 are electrically interconnected by an elongate center positive bussbar 50 (FIG. 2) of good electrical conducting material, preferably copper. The center buss 50 is connected by bolts 52 and angle brackets 50C to each of the crossbars 36 for electrical current flow therebetween. The center buss bar 50 preferably comprises two half-length sections 50A and 50B formed conductively end to end adjacent the split between table sections 12A and 12B by a releasable clamp 51 of conductive material. The clamp here comprises a bridging plate sandwiched by bolts between a pair of clamping plates.

In the particular embodiment shown, the electrical power supply 22 for electropolishing comprises a 6000 amp., 24 volt rectifier unit. The anodes (tubes 15) and cathodes (cathode rods 28) are here fed by 16 No. 4 cables 26 and 24 of 600 amp. capacity of varying lengths. The negative and positive cables are color coded to eliminate confusion. Of the 16 cables, the eight cables 24 are negative connections and four each are connected to the cathode rods 28 through the transverse bussbars 54 and 56 at the supply and discharge ends of the table 12. The remaining eight cables 26 are positive connections and are evenly distributed along and are connected to the positive center bussbar 50, here at about 24-inch intervals. The center bussbar 50 extends over most of the length of the table as can be seen from FIG. 2 and feeds current through the crossbars 36 and associated saddle straps 40 to the tubes 15 during the electropolishing process. All cables preferably end in plate terminals secured at their bussbar connections by conductive (here brass) nuts and bolts.

By connecting several power cables to each bussbar and distributing the cables in spaced relation along the bussbar, uniform current distribution along the bussbar is assured under the high current, low voltage conditions encountered in electropolishing. Also, lighter weight and hence more flexible power cables 24 and 26 can be used, which is a convenience when the d.c. supply 22 is fixed in location and the table is movable.

The rotational drive unit 14 is located adjacent the downstream ends of the tubes 15. The rotational drive 14 comprises a pair of support channels 60 which are fixed by any convenient means (not shown) to, and extend transversely across and beyond the edges of, the top of the table 12. The channels 60 are spaced a short distance apart along the length of the table 12. Two pairs of conventional pillow block bearings 62 are fixed atop the channels 60. The pillow blocks 62 of each pair are coaxial with the intended rotational axis of the corresponding one of the pair of the tubes 15 and are spaced a short distance apart along such axis. Thus, a pair of pillow block bearings 62 are provided for each of the tubes 15. Each coaxially aligned pair of bearings 62 rotatably supports a collet 64 alternatively actuable to grip or release the corresponding tube 15 which is received coaxially therethrough.

A cog belt pulley 66 or the like is located axially between each pair of pillow blocks 62 and is fixed for rotation (as by a set screw 67) coaxially to the outer periphery of a rigid outer collet sleeve 68. The outlet (left in FIG. 4) end of the outer collet sleeve 68 has a half circular circumferential portion 69 in effect cut away and removably held in place by a pair of chordally located screws 70 (FIG. 4A). Thus, the left end of the outer collet sleeve 68 is diametrally split.

The collet 64 further includes a diametrally split inner sleeve comprised of opposed half sleeves 71A and 71B. The split inner sleeve 71A and 71B corresponds by length to the half circular portion 69 of the outer sleeve. The split inner and outer sleeve portions 71B and 69 are radially opposed. The inner sleeve 71A, 71B has an inner diameter sized to snugly but slidably receive therethrough a tube 15 of desired diameter. The inner sleeve half 71A is fixed for rotation with the outer sleeve 68 by a set screw 73. The inner sleeve 71A, 71B is radially tightenable, by the chordal screws 70 on the outer sleeve pulling in the outer sleeve portion 69, to grip the tube 15 in such manner as to axially fix the location of the tube 15 and for rotatable driving of the tube 15 by the pulley 66. The collet inner sleeve is here shown of rigid plastic material, but may be of metal. The upstream (rightward in FIG. 4) end of the split inner sleeve 71A, 71B is chamfered at 74 to ease inserting the left end of the tube 15 leftwardly therethrough. When the size of the tubing to be polished is changed, such may be accommodated by releasing set screw 73, loosening set screws 70, and axially removing the split inner sleeve 71A, 71B from the outer sleeve 68, and thereafter replacing same with an inner sleeve whose inside diameter corresponds to the outside diameter of the new tube 15 to be electropolished. The use of other types of collets adaptable to a wide range of tube diameters is contemplated.

It will be understood that a number of nonrotative components discussed above and hereafter are in contact with the tubes 15 to be rotated, and despite efforts to minimize it, some frictional drag will be encountered in rotating the tubes. Therefore, it is particularly desirable to provide a positive rotational drive for the tubes 15, to ensure that they rotate at the same, desired, speed.

Figure 5:
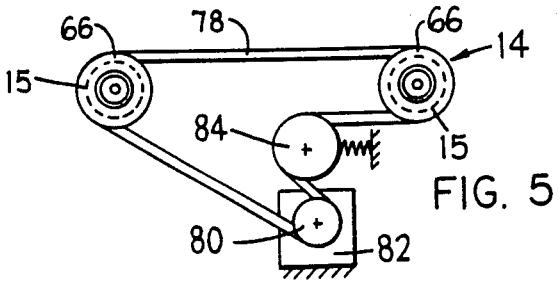
FIG. 5 is a schematic view taken substantially along the line V—V of FIG. 2 and showing the tubing belt drive.

For best electropolishing action, close control of rotational speed is desired. Further, it is desirable that both tubes 15 be driven at the same speed so as to receive the same degree of electropolishing in a repeatable manner. For this reason, a positive (e.g. cog belt) drive is adopted wherein the pulleys 66 (FIG. 5) rotating the tubes 15 are driven by a cog belt 78 which passes thereover and over a motor driven pulley 80 driven at the desired speed by a motor (hereafter referred to as the tube motor) 82 conveniently mountable under the top 12C of the table 12, for example by bolting onto the shelf 12B. If desired, a spring loaded or adjustable idler 84 may be used in a conventional manner to tension the cog belt 78 and thereby ensure against slippage. The motor is of conventional low speed type (e.g., a gear motor) which preferably is variable in speed to ease selecting the best rotational speed. Tube rotation speeds are relatively slow, e.g., about one rpm.

Figure 7:
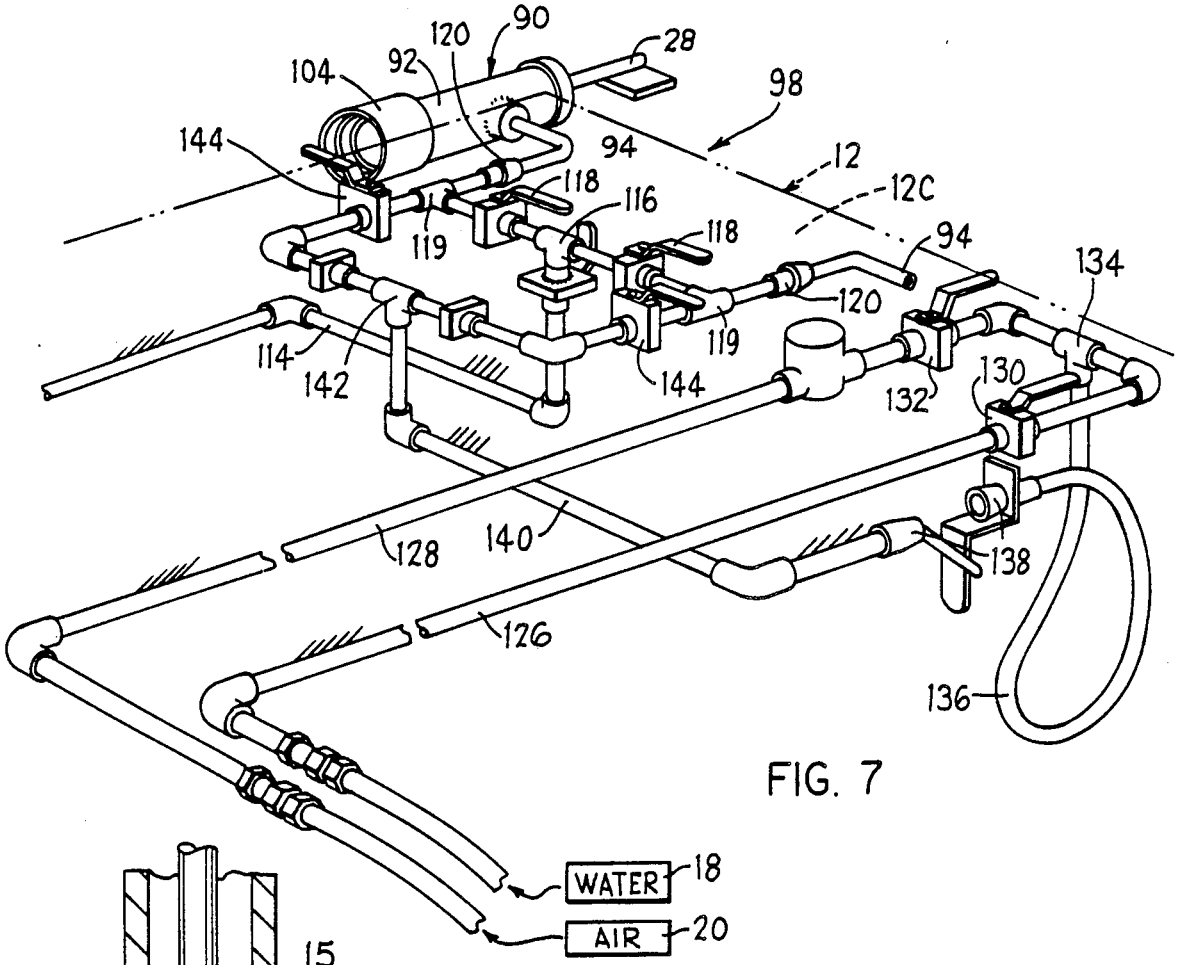
FIG. 7 is an enlarged pictorial view, with the top of the table made invisible, of the control valving manifold for supplying fluids to the inlet ends of the tubes and shown at the right end of the table in FIG. 2.
Figure 6:
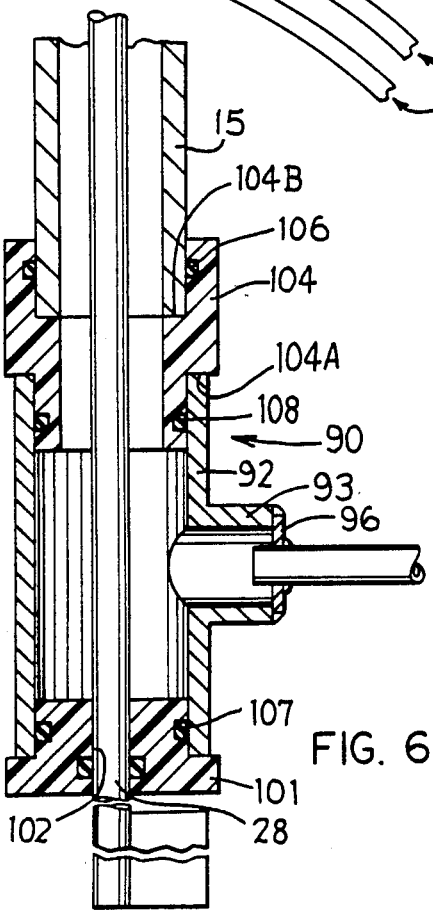
FIG. 6 is a fragmentary enlarged central cross-sectional view, taken substantially along the line VI—VI in FIG. 2, of the inlet adapter for supplying electrolyte to the inlet end of the tube.

The upstream (rightward in FIG. 2) end of each tube 15 is provided with a fluid inlet unit 90 (FIGS. 2, 6 and 7). Each unit 90 includes a tubing line adapter 92 of hollow T-shaped configuration having an inlet leg 93 to which connects at 96 to an inlet fluid line 94. The inlet fluid line 94 is of rigid tubing and, in a manner discussed hereafter, rigidly but releasably locates the unit 90 with respect to a control valving manifold 98 (FIGS. 2 and 7) fixedly located with respect to the table 12.

The crosshead portion of the T-shaped adapter 92 is plugged at its upstream end with an end cap/bushing 101 constructed of electrically insulative rigid material (preferably of Teflon) which closes the end thereof and provides a snug, fluid-tight central opening 102 fixedly receiving the outer end of the upstream one of the cathode rods 28 therethrough. A stepped annular coupling 104 constructed of electrically insulative rigid material (preferably of Teflon) is inserted in the downstream end of the crosshead of the T-shaped adapter 92. The end cap 101 and coupling 104 have reduced diameter inner ends snugly inserted into corresponding ends of the crosshead of the adapter 92 and which have external annular grooves carrying O-rings 107 and 108 preventing fluid leakage therepast from the adapter 92. The coupling 104 has an enlarged diameter outer end receiving the end of the tube 15 and which is internally annularly grooved and fitted with an O-ring 106 to seal against the tube 15 and prevent fluid loss from within the adapter 92 but to still allow rotation of the tube 15 with respect to the coupling 104. The opposed ends of the adapter crosshead and tube 15 axially abut radially outer and inner annular steps 104A and 104B in the coupling 104 to relatively axially locate same. The inlet leg 93 of the adapter 92 is located upstream of the end of the coupling 104 so that the latter does not block fluid entry through the former.

While both fluid inlet units 90 are shown in FIG. 2, the near one thereof is omitted in FIG. 7 to more completely show the control valving manifold 98. The control valving manifold 98 and inlet units 90 are parts of the electrolyte supply system 16 (FIG. 1) and connect to the de-ionized water supply 18 and compressed air supply 20 as hereafter described.

The electrolyte supply system 16 (FIG. 1) includes an electrolyte tank 110 from which electrolyte is supplied by a supply pump 112 (FIG. 1) through a line 114 which extends to the table and runs beneath the top 12C thereof, and rises through the top of the table at the upstream table end to connect to a tee 116 (FIG. 7) of the manifold 98, which splits the electrolyte flow into two symmetric paths. The symmetric paths from the tee 116 each include a manually actuable proportional valve 118, a tee 119 and a quick-disconnect coupling 120 connected to the inlet fluid line 94 of each fluid inlet unit 90. These elements are rigidly interconnected by rigid piping to effect a rigid (though releasable at quick-disconnect coupling 120) connection from the tee 116, which is rigidly located fixedly atop the table, to each unit 90.

Release of the quick-disconnect coupling at 120 permits the upstream end of the tube 15 to be raised, as hereafter discussed, for draining electrolyte or water out of the downstream end thereof and permits the unit 90 to be axially removed from the inlet end of the tube 15 after electropolishing is completed and to be placed upon the inlet end of the new tube to be electropolished, without requiring any dislocation of the control valve manifold 98. When connected, the quick-disconnect coupling 120 (though its parts are relatively rotatable) establishes an axially rigid connection of the unit 90 to the table 12 and prevents the unit 90 from rotating with the pipe 15 by means of the lever arm defined by the line 94. Radial motion of the unit 90 is also prevented by the pipe 15 received rotatably therein and by the cathode rod 28 whose outer end is fixedly clamped to the adjacent transverse buss 54 or 56. All piping leading to the manifold 98 is fixed by any conventional means (not shown) to the table 12. In this way, the unit 90 is held substantially in a fixed position with respect to the table top, both axially and radially of the rotatable tube 15. The two symmetrically placed adjustable valves 118 allow the operator to set a desired electrolyte flow rate to the units 90 and to equalize the flow rate as between the two units 90, so that the two tubes 15 receive identical electrolyte flows.

The electrolyte supply system 16 further includes a means for returning electrolyte from the downstream (outlet) ends of the tubes 15 to the electrolyte tank 110, as hereafter described.

The control valving manifold (FIG. 7) further includes respective water and compressed air lines 126 and 128 leading from the sources 18 and 20 respectively, beneath the top 12C of the table 12, through manual proportioning valves 130 and 132 respectively, a common tee 134, a flexible hose 136, a quick-disconnect coupling 138 (here shown broken), and a common line 140 leading to the central portion of the table 12 and then up through the top 12C thereof to a further tee 142. Thus, if the quick-disconnect 138 is connected and one or the other of valves 130 and 132 is at least partly opened, the selected one of water or air will be symmetrically distributed by the tee 142 through a pair of proportioning valves 144, the remaining port of each of the above-mentioned tees 119, the above-mentioned quick-disconnect couplings 120 and input lines 94 to the two fluid units 90 and thereby to the inlet ends of the tubes 15 to be electropolished. It will be apparent that the valves 144 control proportioning of air and water inputs to the tubes 15 in the same way as do valves 118 with respect to electrolyte. Further, all of the valves 118, 130, 132 and 144 will normally be set in an OFF condition and adjusted to desired ON position only when the desired fluid (electrolyte, water or air) is desired to be applied to one or the other (normally both) of the inlet units 90 and their corresponding tubes 15. The quick-disconnect 138 and flexible tube 136 permit the rightward (FIG. 7) part of the disconnect coupling 138 to be aimed directly into the inlet ends of the tubes 15, when same are disconnected from the inlet units 90 and have their inlet ends elevated for better draining, to rinse or dry such tubes preparatory to removal from the apparatus in a polished condition.

Figure 8:
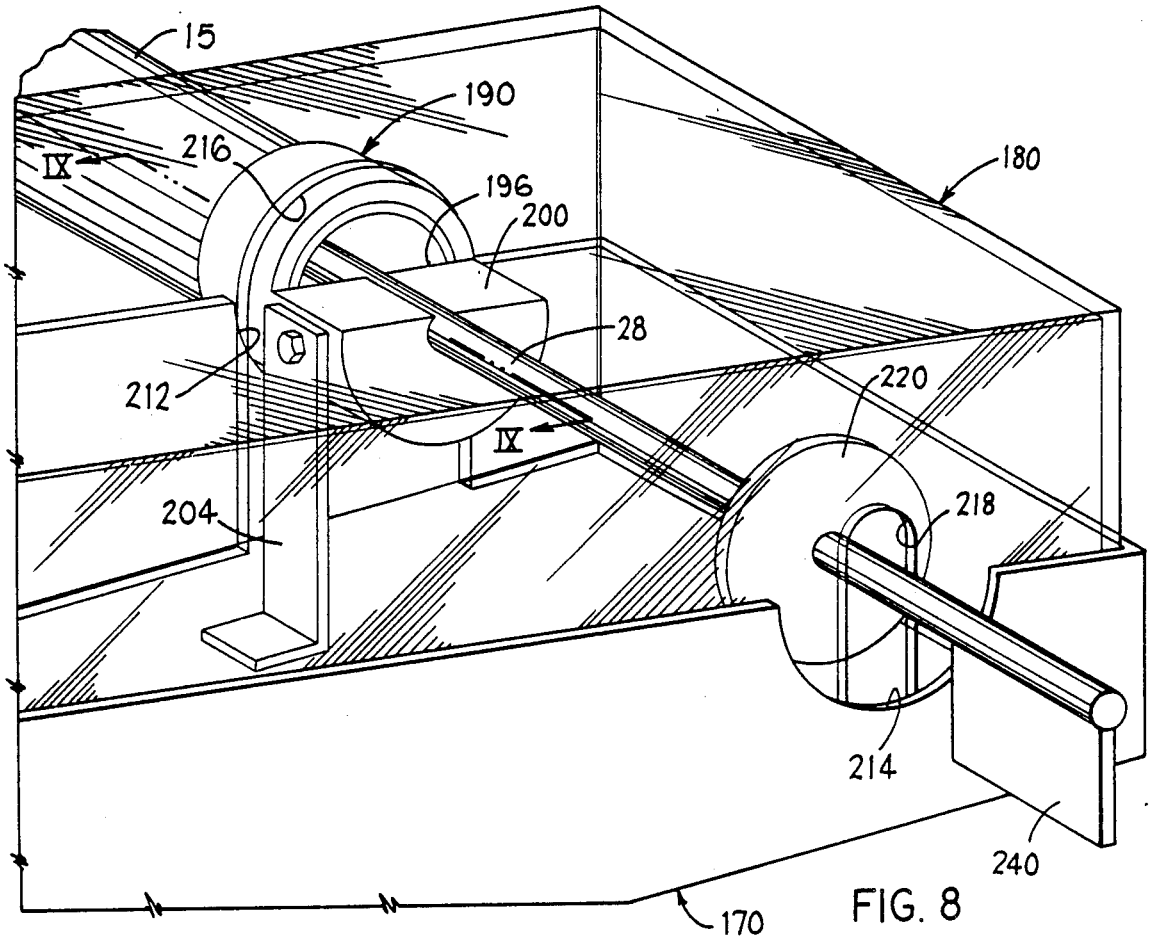
FIG. 8 is an enlarged fragmentary pictorial view of the near portion of the drain trough at the left end of the table in FIG. 2.
Figure 9:
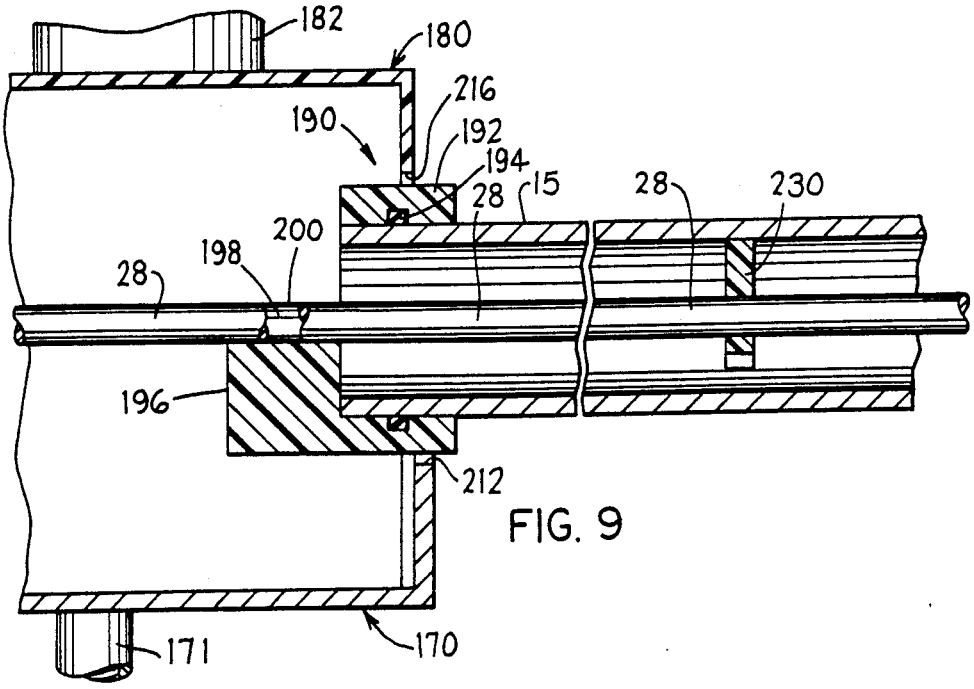
FIG. 9 is an enlarged fragmentary cross-sectional view substantially taken on the line IX—IX of FIG. 8.

Referring now to FIGS. 8 and 9, an electrolyte trough 170 extends across the outlet end of the table top 12C (FIG. 2) beneath the outlet ends of the tubes 15 to receive electrolyte overflow therefrom. A drain line 171 runs from the bottom of the trough and is switchable by a drain valve to empty to a conventional drain 174 (for emptying rinse water) or, alternately, to a discharge reservoir 176 for receiving electrolyte which has overflowed from the outlet end of the tubes. An acid return pump 178 returns electrolyte from the discharge reservoir 176 to the electrolyte tank 110 for recycling through the tubes 15 being polished.

A removable, preferably transparent, plastic cover 180 (FIGS. 2 and 8) is substantially of rectangular form and seats upon and covers the top of the upward opening substantially rectangular trough 170 to act as a splash guard. In the embodiment shown, the cover 180 is supported on the trough by being received snugly within the side walls of the trough and resting upon the floor thereof. The top of the cover opens through an upstanding fume duct 182 to an exhaust fan unit 184 of a conventional type for exhausting fumes generated by the electropolishing process.

A tube outlet end cap 190 (FIGS. 8 and 9) is constructed of electrically insulative rigid material, preferably Teflon. The cap 190 comprises an annular sleeve 192 in which the outlet end of the tube 15 is snugly but relatively rotatably received. An annular seal, here an O-ring 194, is seated in an annular groove within the annular sleeve 192 and prevents backflow of electrolyte leftwardly (FIG. 9) exiting the tube 15 from leaking back rightwardly therepast.

The cap 190 further includes, integral with the annular sleeve 192, and extending downstream therefrom, an end dam 196 in the form of a semicircular cross section extension of the lower half of the annular sleeve 192 and which has an upward facing flat surface. An axial bore 198 centered in the upward facing surface 200 of the dam 196 snugly and sealingly receives therethrough the cathode rod 28. The bore 198 is here coaxial with the end cap 190 and tube 15 and cathode rod 28. In the embodiment shown, the top of the cathode rod 28 is substantially flush with the top 200 of the dam 196. A small circumferential segment at the top of the bore 198 thus opens upwardly through the top surface 200 of the dam.

A bracket 204 rests on the bottom of the trough 170 and is fixed by a screw tangentially to the dam 196 to prevent rotation of the end cap 190 with the tube 15. The bracket 204 holds level the upward facing surface 200 of the end cap 190.

Accordingly, electrolyte liquid flowing toward the outlet end of the tube 15 (toward the end shown in FIGS. 8 and 9) cannot escape until it rises to the level of the top surface 200 of the dam 196, but electrolyte liquid above that level is free to flow over the top surface 200 of the dam and into the overflow reservoir 170 for drain back and recirculation through the electrolyte supply system 16 of FIG. 1. The cathode rod 28, which is fixed and does not rotate with the tube 15, is thus positioned so as to be substantially continuously immersed in the electrolyte liquid in the tube while yet permitting a gas space thereabove and above the liquid for escape of generated gases.

The tops of the walls of the trough 170 are notched at 212 and 214 to receive the end cap 190 and cathode rod 28 therethrough as seen in FIG. 8. Corresponding notches 216 and 218 open downward in the opposed side walls of the cover for the same purpose. A Teflon anti-splash washer 220 is snugly fitted on a cathode rod 28 just inboard of the slots 214 and 218 to further limit any tendency of the electrolyte liquid overflowing the dam 196 into the trough to splash outwardly therefrom.

Figure 4:
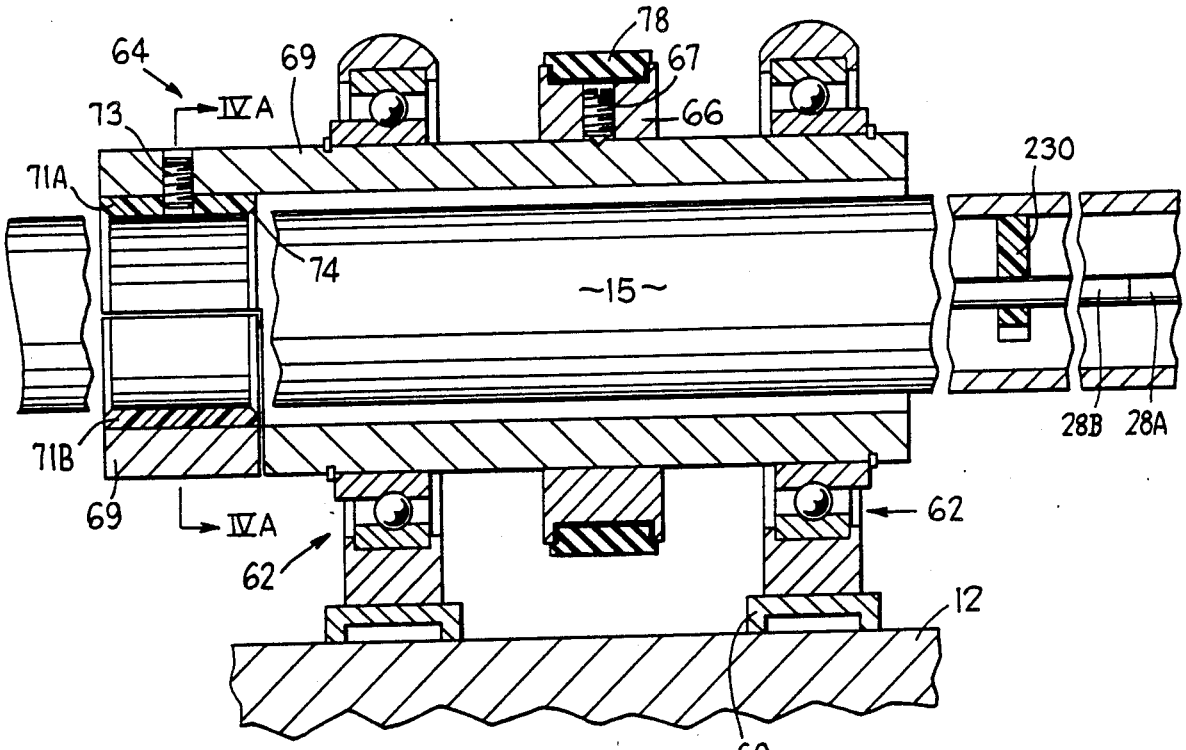
FIG. 4 is a fragmentary enlarged sectional view taken substantially along the line IV—IV in FIG. 2 of one of the bearing and collet assemblies for rotatably driving the tube.
Figure 4A:
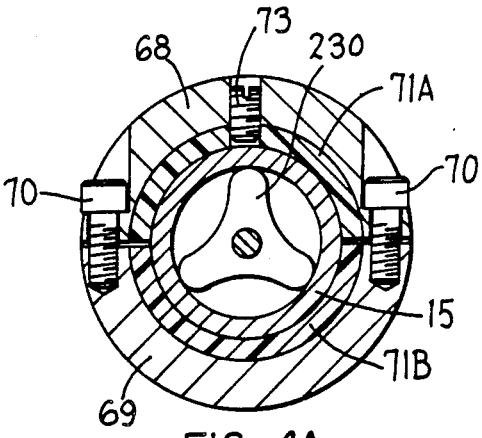
FIG. 4A is a sectional view taken substantially on the line IVA—IVA of FIG. 4.

To correctly position the cathode rod 28 within the tube 15, electrically insulative centering guides 230, preferably of Teflon, hereafter referred to as stars, are fixed on and spaced lengthwise along the cathode rods 28 (FIGS. 2 and 4). Notches (preferably three evenly circumferentially spaced notches) in the periphery of the star 230 permits free gas and electrolyte liquid flow axially therepast while permitting the cathode rod to be accurately centered in the tube 15 by the stars 230 distributed therealong.

The embodiment of the invention shown is particularly adapted to electropolishing tubes of great length (for example 20 feet). To assure uniform current flow between tube 15 and rod 28, the cathode rod for each tube 15 is provided as two half-length rods 28A and 28B which as indicated in FIG. 4 have inner ends in substantially coaxial abutting or close adjacent relation at the middle of the tube 15. Thus, in the embodiment shown, each cathode half rod 28A and 28B is somewhat longer than half the length of the tube 15 (e.g., something in excess of ten feet). Preferably, the two ends of the cathode half rods 28A and 28B meet at about the place of meeting of the two table sections 12A and 12B and of the two half-lengths of the center electrode 50.

Each cathode half-length has at its outer end a terminal plate 240 fixed as by brazing thereto, extending radially therefrom and which normally will be secured in fixed, electrically conducting relation to the corresponding transverse buss 54 or 56 at the inlet or outlet end by suitable clamping means, such as a C-clamp not shown.

OPERATION

Once the table is assembled, rigged for the size tubing to be polished, and wheeled into place, the electropolishing operation is ready to be started. A typical polishing operation can be summarized by the following steps.

Two 20-foot stainless steel tubes 15 are placed on the crossbars 36 and the tubes are slid toward the discharge end of the table into position, i.e., ahead each into its tubing collet 64 (making sure that shims 36B of proper height support the crossbars 36). Next, one half section 28B of the two-piece cathode rod 28 is slid into the I.D. of each tube from the discharge end (first making sure the centering Teflon stars 230, outlet end cap 190 and anti-splash washer 220 are in place on the cathode rod) and the outlet end cap 190 is fitted over the discharge end of the corresponding tube 15. The notches 212 and 214 in the trough 170 are big enough to pass the end cap 190 and anti-splash washer 220. Next, the other half section 28A of the two-piece cathode rod 28 is slid into each tube 15 from the supply end of the table 12 until the two pieces touch (making sure the centering Teflon stars 230 and inlet unit 90 are in place on each cathode half section 28A). Each inlet unit 90 is fitted over the end of its tube 15. The quick-disconnect fittings 120 (which supply acid, air, and de-ionized water from the control valving manifold 98) are then connected, to establish flow paths to the lines 94 and inlet units 90.

The tubes 15 are locked in the motor drive collet 64 by tightening the Allen screws 73 down on the tubing (first making sure the split inner sleeve 71A, 71B is of inner diameter to snugly grip the tube 15). All saddle straps 40 are locked down on the tubes 15 by locking the toggle clamps 46 to secure the tubing in the V-notches of the crossbars 36. The transverse bussbars 54 and 56 (screwed to the cables 24) are fixed to the cathode rods 28A and 28B, as by C-clamps not shown. The transverse bussbars may be supported with respect to the table 12 by any convenient insulative means not shown so that their weight does not tend to bend or bow the cathode rods 28.

The transparent Lexan cover 180 is placed over the trough 170 at the discharge end of the table 12, making sure that the exhaust fan 184 is working.

The valves 118 on the control valving manifold 98 are opened and the pumps 112 and 178 are energized, to allow the electrolyte to enter and flow through the tubes 15. Typical acid compositions, temperatures and amperage and voltage ranges are shown in Table 1 for several tube compositions.

TABLE 1

ELECTROLYTES AND OPERATING CONDITIONS FOR ELECTROPOLISHING

| | Electrolyte Composition | Operating Conditions ($dm^2$ = 10 $ft^2$) |
|---|---|---|
| Aluminum and Aluminum Alloys | | |
| Sodium carbonate | 15% | 74–88° C. (165–190° F.) |
| Trisodium phosphate | 5% | 5–6 A/$dm^2$ (50–60 A/$ft^2$) |
| Water | 80% | |
| Fluoboric acid | 2.5% | 30° C. (86° F.) |
| | | 15–30 volts |
| | | 1–2 A/$dm^2$ (10–20 A/$ft^2$) |
| Phosphoric acid | 50–75% | 65–95° C. (149–203° F.) |
| Sulfuric acid | 15% | 10–18 volts |
| Chromic acid | 5–20% | 5–20 A/$dm^2$ (50–200 |

TABLE 1-continued

ELECTROLYTES AND OPERATING CONDITIONS FOR ELECTROPOLISHING

| | Electrolyte Composition | Operating Conditions ($dm^2$ = 10 $ft^2$) |
|---|---|---|
| | | A/$ft^2$) |
| Water | Balance | |
| | Copper and Copper Alloys | |
| Modified phosphoric acid and alcohol or glyed mixtures (proprietary) | | 20-40° C. (68-104° F.) 6-15 volts 2-10 A/$dm^2$ 20-100 A/$ft^2$ |
| Phosphoric acid | 75-84% | 40-70° C. (104-158° F.) |
| Chromic acid | 0-15% | 12-18 volts |
| Water | Balance | 10-30 A/$dm^2$ (100-300 A/$ft^2$) |
| | Nickel and Nickel Alloys | |
| Phosphoric acid | 15-70% | 30-50° C. J(86-122° F.) |
| Sulfuric acid | 15-60% | 10-18 volts |
| Hydrochloric acid | 0-2.5% | |
| Water | Balance | |
| | Stainless Steels | |
| Phosphoric acid | 40-65% | 45-80° C. (113-176° F.) |
| Sulfuric acid | 15-45% | 10-18 volts |
| Water | Balance | 5-50 A/$dm^2$ (50-500 A/$ft^2$) |
| Phosphoric acid | 30-65% | 45-80° C. (113-176° F.) |
| Sulfuric acid | 15-55% | 6-18 volts |
| Organic additives | 2.5-15% | 5-50 A/$dm^2$ (50-500 A/$ft^2$) |
| Water | Balance | |
| Phosphoric acid | 0-40% | 45-85° C. (113-185° F.) |
| Sulfuric acid | 15-55% | 6-18 volts |
| Glycolic acid | 10-30% | 5-50 A/$dm^2$ (50-500 A/$ft^2$) |
| Water | Balance | |
| | Carbon Steels | |
| Phosphoric acid | 45-75% | 45-60° C. (113-140° F.) |
| Sulfuric acid | 5-40% | 10-18 volts |
| Chromic acid | 0-12% | 10-30 A/$dm^2$ (100-300 A/$dm^2$) |
| Water | Balance | |

Once the acid (electrolyte) begins to exit the tubes 15 at the discharge end of the table, the motor drive 80 is turned on to rotate the tubes, preferably at about 1 rpm. The acid flow rate preferably is set at about one gallon per minute for tubing up to 1½" in diameter and about two gallons per minute for tubing 2", 3" and 4" in diameter. The amperage, voltage and polishing time are determined and the rectifier (DC supply) 22 is activated. Typical values are shown in the accompanying chart (Table 2).

TABLE 2

Operating details for Electropolishing of Stainless Steel Tubing - 304 & 316 (20 feet in length)

| Tubing Size | Cathode (Solid Copper) | Polishing Time | Voltage | Amperage |
|---|---|---|---|---|
| ⅝" dia | ¼" dia | 8 min. | 6-7 D.C. | 1000 |
| ¾" dia | ⅜" dia | 8 min. | 6-7 D.C. | 1000 |
| 1" dia | ⅜" dia | 10-15 min. | 7-8 D.C. | 2000 |
| 1½" dia | ½" dia | 10-15 min. | 8-9 D.C. | 3000 |
| 2" dia | ⅝" dia | 10-15 min. | 8-9 D.C. | 3000 |
| 3" dia | 1" dia | 23 min. | 8-9 D.C. | 4000 |
| 4" dia | 1½" dia | 23 min. | 9-10 D.C. | 4000-5000 |

The electrolyte being discharged is collected in the discharge trough 170 and deposited in the 50 gallon stainless steel drum 176 so it can be pumped back to the holding tank 110 and recirculated again.

When the electropolishing time has expired, the acid pump 112 is turned off and the acid feeding valves 118 on the control valving manifold 98 are turned off. The Lexan cover 180 is removed from the trough 170 at the discharge end of the table 12. The Teflon dam fittings 196 are pulled from the tubes 15 at the discharge end of the table and residual acid in the tubes is allowed to run out freely into the trough 170 and discharge reservoir 176.

The air and water sources 20 and 18 connect to the table by pipes 128 and 126. By carefully adjusting the control valving manifold valves 132 and 144, a little air is gently blown through the tubes 15 to recover as much acid as possible before rinsing.

The pressurized air is turned off at 132 and the de-ionized rinse water is turned on at 130. The I.D. of the tubes 15 are thoroughly rinsed. The rinse water color at the discharge end of the table is watched. The de-ionized water should turn from green to clear when the tubes 15 are completely rinsed. Then the water is turned off and the compressed air turned on again to blow the tubes out while they are still turning in the motor drive.

The motor drive 80 is then shut off. The Allen screws 70 that hold the tubes 15 in the motor drive collet 64 are loosened and the clamps 46 and the straps 40 are released. The cathodes 28A and 28B (with their end fittings and stars) are removed from both ends of the tubing. The cathode rods are wiped off with a damp towel to remove any residue of acid. The supply ends of the tubes 15 are elevated several inches above the supply end of the table. With a spray nozzled hose (e.g., hose 138 with a conventional nozzle added) the inside of the tubes 15 once again are rinsed to assure that absolutely all residue of electrolyte has been removed. This will enable the tubes to dry without streaking.

Then the polished tubes 15 are removed from the table 12, elevated at one end and allowed to dry. With good ventilation, the tubes 15 should be dry in about a half hour. The whole polishing process typically takes about 30 minutes to complete.

Following electropolishing, workpieces should (as in the above example) be thoroughly rinsed to completely remove the acid electrolyte. Some electropolishing baths are extremely viscous and difficult to rinse, especially when these solutions are old. In the case of these viscous baths, a warm water rinse may be required in the first stage of the rinse cycle. Certain parts that can entrap the electrolyte may require additional treatment in a mild alkaline dip (for example, 15 to 30 g/l sodium bicarbonate or 1 to 2 percent by weight ammonia) to neutralize any residual acidity and prevent subsequent corrosion or staining. Aged electrolytes, high in dissolved metal content, tend to leave films of metal salt on the workpiece, even with thorough rinsing. These residuals usually dissolve in a dilute acid dip. The strength and type of acid used for this dip depend on the metal being electropolished. It should be strong enough to cut the residual film without attacking the basic metal.

It will be noted from Table 2 above that it has been found appropriate to increase polishing time, voltage and amperage with, but at a lesser rate than, the rate of increase of tube diameter. Further, it will be noted that the values in Table 2 comply with a relationship of polishing time, voltage and amperage with respect to tube diameter such that 1/10 the square root of the product of polishing time in minutes times voltage in volts times amperage in kilo amperes approximates tube diameter in inches. The electrolyte employed in connection with FIG. 2 was a phosphoric acid-sulfuric acid-water electrolyte.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A method for electropolishing the interior of elongate tubes comprising:
- preselecting electrolyte type, temperature and flow rate, along with tube rotation speed and DC supply voltage;
- locating a plurality of table sections in end-to-end relation;
- laying a tube to be electropolished on a plurality of conductive crossbars fixed to and distributed along the lengths of the table sections;
- axially shifting said tube in a downstream direction through a rotatably drivable chuck on the downstream one of said table sections and tightening said chuck on said tube to enable rotative driving of said tube;
- axially inserting partial length cathode rods substantially coaxially into the inlet and outlet ends of said tube, while inserting into said tube spacers spaced along said cathode rods and installing on the ends of said tube end caps carried by said cathode rods;
- securing said tube to said crossbars in relatively rotatable but electric current conducting relation;
- rotationally driving said tube at said chuck;
- forcing electrolyte liquid through said inlet end cap, flowing said liquid through the length of the tube and along same to overflow a dam at the outlet end of the tube while maintaining the cathode rod immersed in said liquid, applying positive and negative electrical connections to said crossbars and the protruding ends of said partial length cathode rods for a selected time to electropolish the interior of said tube while collecting electrolyte liquid overflowing from the dammed outlet end of the tube and recycling same through a loop for introduction at the inlet end of the tube;
- upon completion of electropolishing, terminating electrolyte supply to the inlet and of the tube, removing said outlet dam from the outlet end of said tube, and sequentially supplying a rinse liquid and a drying gas to flow from the inlet end of the tube out the outlet end thereof to remove residual electrolyte liquid and any products of electropolishing from the tube;
- stopping said rotational drive and releasing the outlet end of the tube from clamped relation in said chuck;
- removing said end caps and cathode rods from the tube, unclamping said tube from said table and raising the upstream end of the tube to tilt the tube somewhat and further rinsing the tube while tilted;
- diverting rinse liquid out of the electrolyte liquid loop to a suitable drain.

2. A method for electropolishing the interior of elongate tubes, comprising:
- substantially coaxially locating and axially fixing a cathode rod means within the tube to extend substantially the length of the tube;
- electropolishing the interior of said tube for a time by rotatably driving the tube while circulating electrolyte liquid through the length of the tube and applying a positive to negative voltage drop across the tube and cathode rod means, the electrolyte flow rate through the tube being in the range of about 1 to 2 gallons per minute for tubing in the range of about $\frac{5}{8}''$ to 4" diameter, flow rates in the upper end of the flow rate range applying to tubing diameters in the upper end of the tubing diameter range.

3. The method of claim 2, in which the tube is of stainless steel, the electrolyte temperature is in the range of about 40° to 80° C., the voltage is in the range of about 6 to 18 volts, the current density is in the range of about 50 to 500 amperes per square foot of tubing interior surface area, the cathode diameter is about $\frac{1}{2}$ to $\frac{1}{3}$ the tube diameter, the electropolishing time in minutes is about five to ten times tube diameter in inches, and the voltage is related to tube diameter so as to be about three to 10 times the tube diameter in inches.

4. The method of claim 2, wherein for tubes of increasing diameter, the electropolishing time, voltage and amperage are increased but at rates less than the rate of increase of tube diameter.

5. The method of claim 2, in which electropolishing time, voltage, and amperage are related to tube diameter such that 1/10 the square root of the product of polishing time in minutes times voltage in volts times amperage in kilo amperes approximates tube diameter in inches.

6. A method for electropolishing the interior of elongate tubes comprising:
- rotatably supporting plural substantially horizontal tubes to be interiorly electropolished;
- rotatably driving said tube in synchronism;
- supporting a cathode rod in each tube;
- electrically connecting positive and negative terminals of a DC electrical supply to said tubes and cathode rods respectively;
- simultaneously feeding electrolyte liquid to the input end of said tubes via manifold means; and
- receiving liquid electrolyte from the outlet end of said tubes.

7. A method for electropolishing the interior of elongate tubes comprising:
- preselecting electrolyte type, temperature and flow rate, along with tube rotation speed and DC supply voltage;
- securing a tube to be electropolished in rotatable but current carrying relation on a plurality of conductive crossbars fixed to and distributed along the length of the table;
- clamping said tube in a rotatably drivable chuck on said table to enable rotative driving of said tube;
- providing a cathode extending substantially the full length of said rotatable tube by axially inserting partial length cathode rods substantially coaxially into the inlet and outlet ends of said tube, while spacing said cathode rods from the interior wall of said tube and installing end caps on the ends of said tube and outer ends of said cathode rods;
- rotationally driving said tube at said chuck;
- electropolishing the interior of said tube by forcing electrolyte liquid through said inlet end cap, flowing said liquid through the length of the tube and along same to overflow a dam at the outlet end of the tube while maintaining the cathode rods substantially immersed in said liquid, and applying positive and negative electrical connections to said crossbars and the outer ends of said partial length cathode rods for a selected time to electropolish the interior of said tube;

upon completion of electropolishing, terminating electrolyte supply to the inlet end of the tube rinsing the tube;

stopping said rotational drive and releasing the outlet end of the tube from clamped relation in said chuck;

removing said end caps and cathode rods from the tube and, unclamping said tube from said table.

8. A method for electropolishing the interior of elongate stainless steel tubes, comprising:

substantially coaxially locating and axially fixing a cathode rod means within the tube to extend substantially the length of the tube;

electropolishing the interior of said tube for a time by rotatably driving the tube while circulating electrolyte liquid through the length of the tube and applying a positive to negative voltage across the tube and cathode rod means wherein, for tubing in the range of about $\frac{5}{8}''$ to 4" diameter: (1) the electrolyte flow rate through the tube is in the range of about 1 to 2 gallons per minute, (2) the voltage is in the range of about 6 to 10 volts DC, (3) the current is in the range of about 1,000 to 5,000 amperes for a pair of 20 foot tubes, (4) the cathode diameter is about $\frac{1}{2}$ to $\frac{1}{3}$ the tube diameter, (5) the electropolishing time in minutes is about five to ten times tube diameter in inches, (6) the voltage is related to tube diameter so as to be about three to 10 times the tube diameter in inches, and (7) the flow rate, voltage and amperage are increased with increasing tube diameter, but at rates less than the rate of increase of tube diameter.

9. The method of claim 8, in which polishing time, voltage and amperage are related to tube diameter such that 1/10 the square root of the product of polishing time in minutes times voltage in volts times amperage in kilo amperes approximate tube diameter in inches.

10. The method of claim 8, in which the electrolyte temperature is in the range of about 40° to 80° C.

* * * * *

UNITED STATES PATENT AND TRADEMARK OFFICE

CERTIFICATE OF CORRECTION

PATENT NO. : 4 705 611

DATED : November 10, 1987

INVENTOR(S) : Thomas L. GRIMES et al

It is certified that error appears in the above-identified patent and that said Letters Patent is hereby corrected as shown below:

Column 14, Line 17; Change "80°C.," to ---80°C,---.
Line 30; Change "voltage, and" to ---voltage and---.
Line 39; Change "tube" to ---tubes---.
Column 16, Line 21; Change "approximate" to ---approximates---.

Signed and Sealed this

Fifth Day of April, 1988

*Attest:*

*Attesting Officer*

DONALD J. QUIGG

*Commissioner of Patents and Trademarks*